US007007675B2

(12) United States Patent
Ida et al.

(10) Patent No.: US 7,007,675 B2
(45) Date of Patent: Mar. 7, 2006

(54) FUEL SUPPLY SYSTEM FOR INTERNAL COMBUSTION ENGINE AND FUEL TRANSFER TUBE

(75) Inventors: Satoshi Ida, Atsugi (JP); Takashi Kokojima, Atsugi (JP); Takeshi Hidaka, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/765,473

(22) Filed: Jan. 28, 2004

(65) Prior Publication Data

US 2004/0182453 A1 Sep. 23, 2004

(30) Foreign Application Priority Data

Jan. 29, 2003 (JP) ..... 2003-020213

(51) Int. Cl.
*F02M 37/04* (2006.01)

(52) U.S. Cl. ..... 123/468; 123/509; 123/514

(58) Field of Classification Search ..... 123/467, 123/198 D, 468, 469, 470, 456, 509, 514
See application file for complete search history.

(56) References Cited

U.S. PATENT DOCUMENTS 5,476,080 A * 12/1995 Brunnhofer ..... 123/468
5,797,373 A * 8/1998 Kleppner et al. ..... 123/495
5,797,377 A * 8/1998 Fischerkeller ..... 123/514
5,819,708 A * 10/1998 Buratti et al. ..... 123/468
6,102,011 A * 8/2000 Meyer et al. ..... 123/509
6,189,510 B1 * 2/2001 Jaeger et al. ..... 123/468
6,257,627 B1 * 7/2001 Fujiwara et al. ..... 285/305
6,460,511 B1 * 10/2002 Kato ..... 123/468
6,505,644 B1 * 1/2003 Coha et al. ..... 137/565.22
6,508,275 B1 * 1/2003 Sadr et al. ..... 138/109
6,553,973 B1 * 4/2003 Coha et al. ..... 123/509
2001/0003995 A1 * 6/2001 Imaeda et al. ..... 141/82

FOREIGN PATENT DOCUMENTS

JP 2000-257526 A 9/2000
JP 2000-275526 A 10/2000

* cited by examiner

*Primary Examiner*—Carl S. Miller
(74) *Attorney, Agent, or Firm*—Sughrue Mion, PLLC

(57) ABSTRACT

In a fuel supply system constituted such that there is disposed a saddle type fuel tank provided with a main chamber and an auxiliary chamber on both sides of an upwardly protruding center portion of a bottom face thereof, a fuel transfer tube which is mounted to lie over the protruding portion of the fuel tank, is connected to a fuel introduction port of a jet pump disposed on a main chamber side, to pump fuel in the auxiliary chamber via the fuel transfer tube, at least a part of the fuel transfer tube is formed by arranging alternately a plurality of bellows portions each of which cross section is changed, and a plurality of straight portions each of which cross section is fixed.

15 Claims, 4 Drawing Sheets

(A)

(B)

FUEL SUPPLY SYSTEM FOR INTERNAL COMBUSTION ENGINE AND FUEL TRANSFER TUBE

FIELD OF THE INVENTION

The present invention relates to a fuel supply system for an internal combustion engine, which is disposed in a saddle type fuel tank provided with a main chamber and an auxiliary chamber on both sides of an upwardly protruding center portion of a bottom face thereof, for transferring fuel in the auxiliary chamber side to the main chamber side, and a fuel transfer tube used for the transfer of the fuel.

RELATED ART

In a rear-wheel-drive vehicle or a four-wheel-drive vehicle, a propeller shaft for driving rear wheels is disposed on a center part of an automotive body to extend in a longitudinal direction. Therefore, in this kind of vehicle, a bottom face of a fuel tank arranged on a bottom portion of the automotive body is formed in a shape bypassing to surround the propeller shaft, that is, in a saddle shape, so as to enlarge the tank volume as much as possible.

In such a saddle type fuel tank, as disclosed in Japanese Unexamined Patent Publication No 2000-257526, the fuel tank is divided into a main chamber into which fuel is sucked by a fuel pump and an auxiliary chamber having no suction hole, by a protruding bottom face bypassing to surround the propeller shat. Therefore, when the fuel level is lowered as a result of fuel consumption, generally, the fuel from the auxiliary chamber is supplied to the main chamber by a negative pressure of return fuel, a so-called jet pump.

Namely, the jet pump is disposed on an outlet of a fuel return pipe, so that the fuel from the auxiliary chamber is sucked into the main chamber via a fuel transfer tube connected to the jet pump, by the negative pressure with the discharge of return fuel from a discharge port of the jet pump.

Here, the fuel transfer tube needs to be mounted by being bent to lie over the protruding bottom face of the saddle type fuel tank.

For this purpose, there is a fuel transfer tube formed in the shape of bellows as a whole. In this case, when the fuel in the auxiliary chamber is reduced and then the jet pump starts to pump the air therein, the airflow is detached from an inner wall face of bellows shape to be turbulence. As a result, the air is vibrated to occur a noise.

Note, there is a fuel transfer tube in which a bellows tube made of resin is connected to an end portion on the side of main chamber made of metal pipe bent from the auxiliary chamber side to lie over the protruding portion. Even in such a case, sometimes, a noise occurs from the bellows tube, resulting in the large level of noise.

Further, especially in the fuel transfer tube the entire of which is formed in bellows shape, the rigidity thereof is insufficient, and therefore, there occurs an abrasion noise when the tube interferes the inner wall of the tank due to the fuel vibration in the tank.

The present invention has been accomplished in view of the above problems and has an object to enable the rigidity to be ensured while suppressing the occurrence of noise, in a fuel supply system for an internal combustion engine and a fuel transfer tube, which are applied to a saddle type fuel tank.

SUMMARY OF THE INVENTION

In order to achieve the above object, a fuel supply system for an internal combustion engine according to the present invention is constituted so that a fuel transfer tube mounted so as to lie over a protruding portion of a saddle type fuel tank, is connected to a fuel introduction port of a jet pump disposed on a main chamber side of the fuel tank, to suck fuel inside an auxiliary chamber into the main chamber via the fuel transfer tube, and also at least a part of the fuel transfer tube is constituted by arranging alternately a plurality of bellows portions each of which cross section is changed, and a plurality of straight portions each of which cross section is fixed.

Further, a fuel transfer tube according to the present invention is constituted so that a bellows portion of which cross section is changed and a straight portion of which cross section is fixed, are arranged alternately.

The other objects and features of this invention will become understood from the following description with reference to the accompanying drawings.

PREFERRED EMBODIMENT

Figure 1:
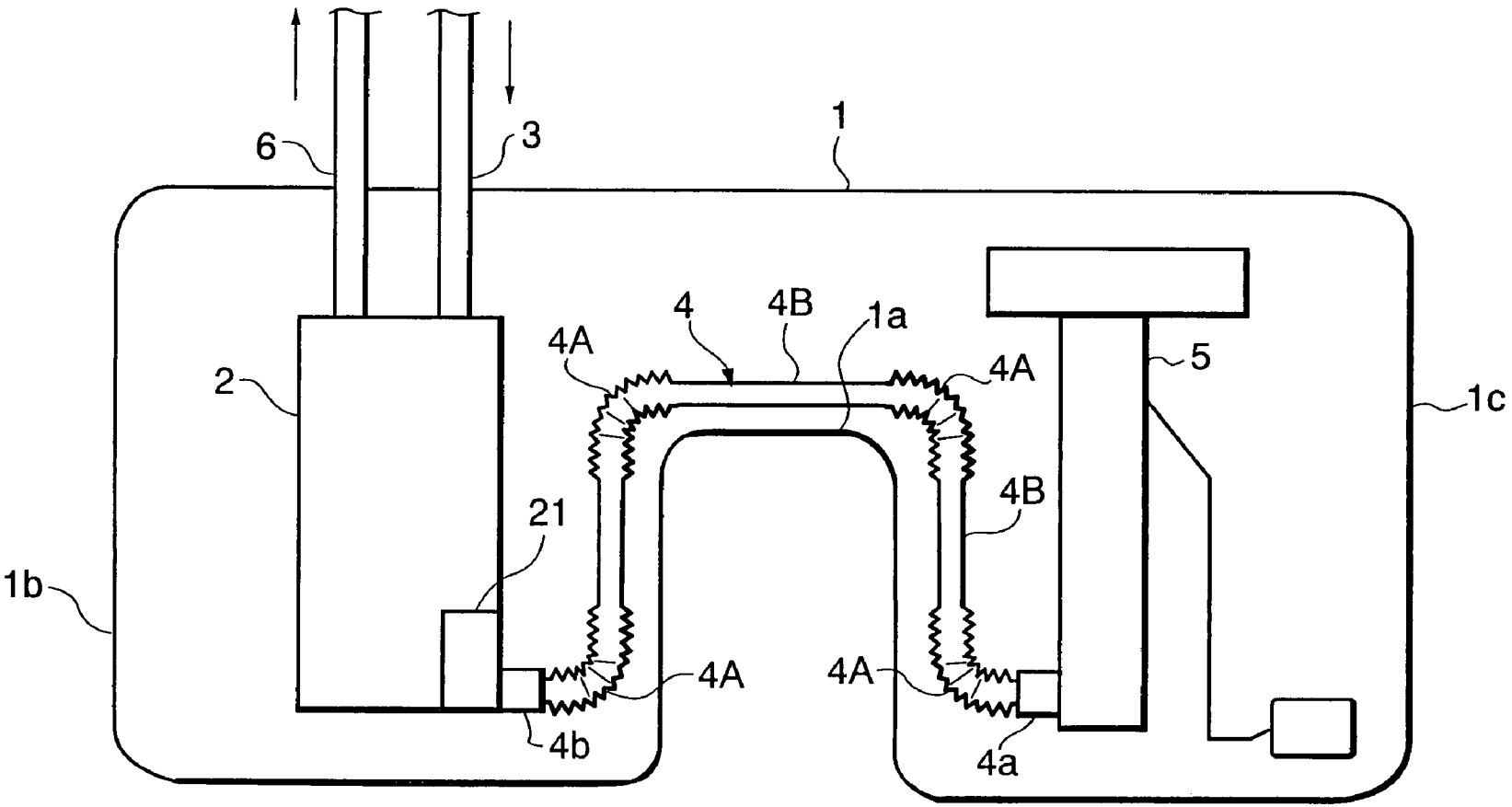
FIG. 1 is a configuration diagram showing an embodiment of a fuel supply system for an internal combustion engine according to the present invention.
Figure 2:
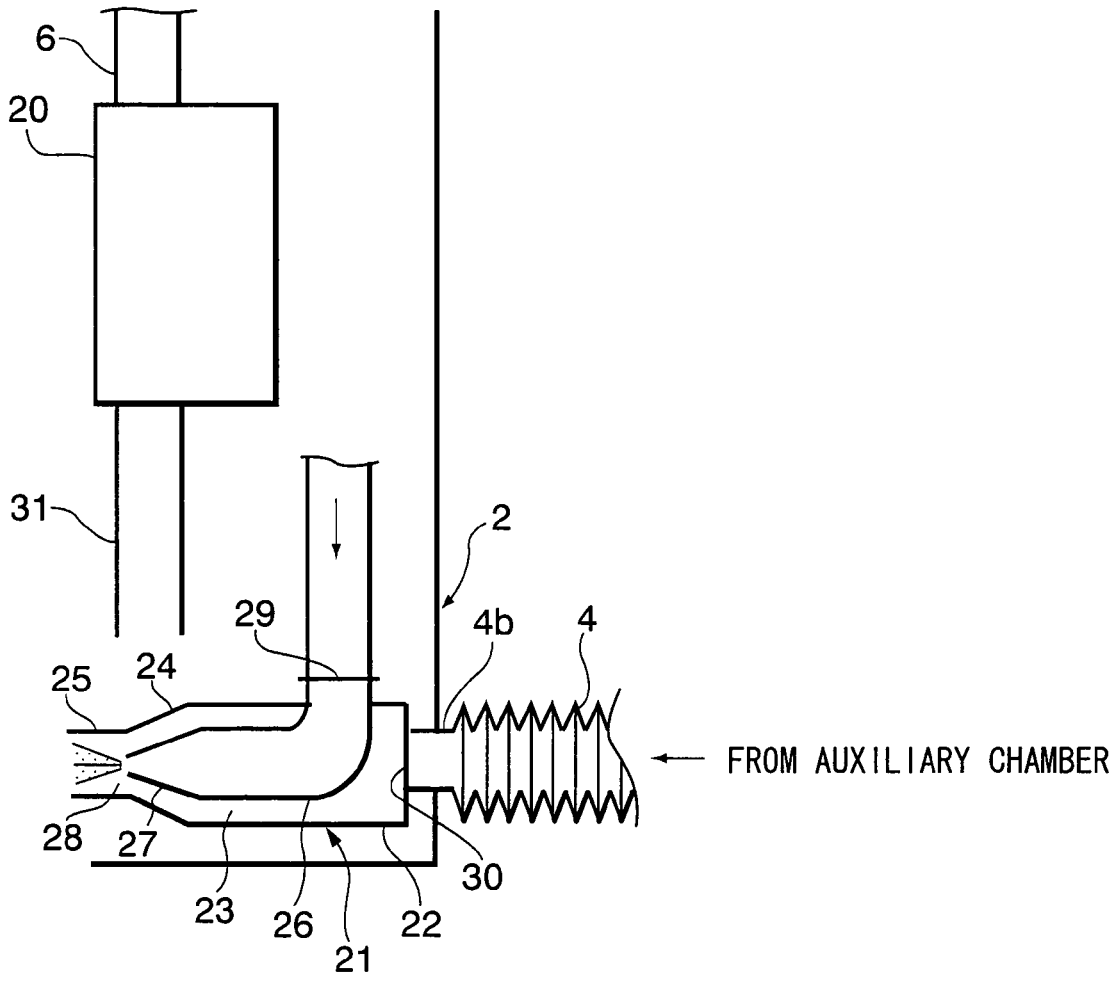
FIG. 2 is an enlarged diagram showing a configuration of a jet pump periphery in the embodiment.
Figure 3:
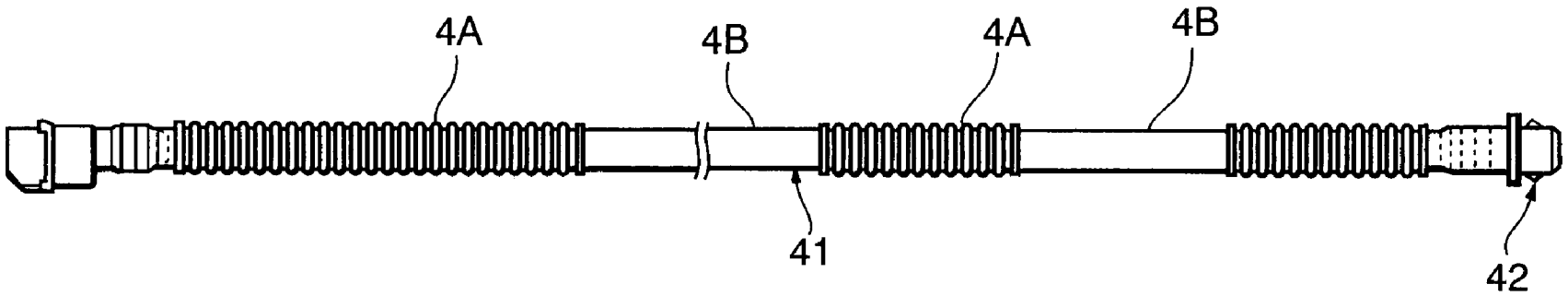
FIG. 3 is a diagram showing an appearance of a fuel transfer tube according to the present invention used for the embodiment.

A specific embodiment of a fuel supply system according to the present invention will be described based on the drawings.

A fuel tank 1 disposed on a rear-wheel-drive vehicle or a four-wheel-drive vehicle is formed such that a center portion 1*a* of a bottom face thereof protrudes upwardly so as to bypass a propeller shaft, and is provided with a main chamber 1*b* and an auxiliary chamber 1*c* on both sides of protruding portion 1*a*.

A pump unit 2 incorporating therein a pump body 20 is installed in main chamber 1*b*, and a jet pump 21 is mounted on a bottom portion of pump unit 2.

Jet pump 21 includes a negative pressure chamber 23 in a housing 22, and a narrowed diameter portion 24 and a fuel injection nozzle 25 are formed on one side of jet pump 21. Further, an approximately L-shaped nozzle member 26 is disposed in negative pressure chamber 23. A horizontal end of nozzle member 26 is formed in a tapered shape to serve as a nozzle hole 27. Nozzle hole 27 is located in narrowed diameter portion 24 with required clearance, to form a negative pressure generating portion 28 on a boundary portion between narrowed diameter portion 24 and fuel injection nozzle 25. Further, to a vertical inlet end 29 of nozzle member 26, a fuel return pipe 3 returning fuel from an engine is connected.

A fuel outlet 4*b* of a fuel transfer tube 4 according to the present invention is connected to a fuel introduction port 30 formed on housing 22, and a fuel inlet 4*a* of fuel transfer tube 4 is connected to a lower wall of a fuel-flow gauge 5 installed in auxiliary chamber 1*c*. Fuel transfer tube 4 is formed of resin material as a whole, and is constituted by arranging alternately a plurality of bellows portions 4A each of which cross section is changed, and a plurality of straight portions 4B each of which cross section is fixed.

The bottom portion of pump unit 2 communicates with a fuel suction port of pump body 20 via a fuel suction pipe 31, and a fuel discharge port of pump body 20 is connected to a fuel supply pipe 6 supplying the fuel to the engine (refer to FIG. 1).

Next, a basic fuel supply operation of fuel supply system having the above configuration will be described.

When the fuel returned from fuel return pipe 3 is injected from nozzle hole 27 of nozzle member 26, a negative pressure is generated in negative pressure generating portion 28 due to an ejector effect so that negative pressure chamber 23 becomes under a negative pressure. As a result, the fuel retained in auxiliary chamber 1*c* is sucked by negative chamber 23 to be transferred via fuel transfer tube 4 to main chamber 1*b*.

The fuel transferred from auxiliary chamber 1*c* is ejected to the bottom portion of pump unit 2 from fuel injection nozzle 25 together with the return fuel, and then pumped into pump body 20 via fuel suction pipe 31 and discharged from pump body 20, to be supplied to the engine via fuel supply pipe 6.

The fuel in main chamber 1*b* flows together the fuel from auxiliary chamber 1*c* and pumped into pump body 20, to be supplied to the engine, by a jet pump also installed in pump unit 21 or by communicating main chamber 1*b* with negative pressure chamber of jet pump 21 via a pipe.

Next, the effect obtained by disposing fuel transfer tube 4 according to the present invention will be described.

When the fuel level is lowered as a result that the fuel in auxiliary chamber 1*c* is reduced by pumping to transfer the fuel in auxiliary chamber 1*c* by jet pump 21 in the above described manner, fuel inlet 4*a* of fuel transfer tube 4 is exposed to the air, to start to suck the air therein.

In such a case, if the length of bellows portion is long as in the conventional technique, the airflow is detached from an inner wall face of bellows shape to be turbulence. As a result, the air is vibrated to occur a noise. However, in the present invention, since fuel transfer tube 4 is constituted by arranging alternately the plurality of bellows portions 4A and the plurality of straight portions 4B, the length of each bellows portion is made short, thereby enabling to suppress the cause of noise occurrence. Further, even in the case where the airflow is detached from the inner wall face of bellows portion 4A, the airflow is again adjusted in straight portion 4B disposed downstream of bellows portion 4A, thereby enabling to efficiently prevent the noise occurrence.

Further, since the rigidity is ensured by straight portion 4B, it is possible to prevent an abrasion noise from occurring when the tube interferes the inner wall of the tank due to the fuel vibration.

Figure 4:
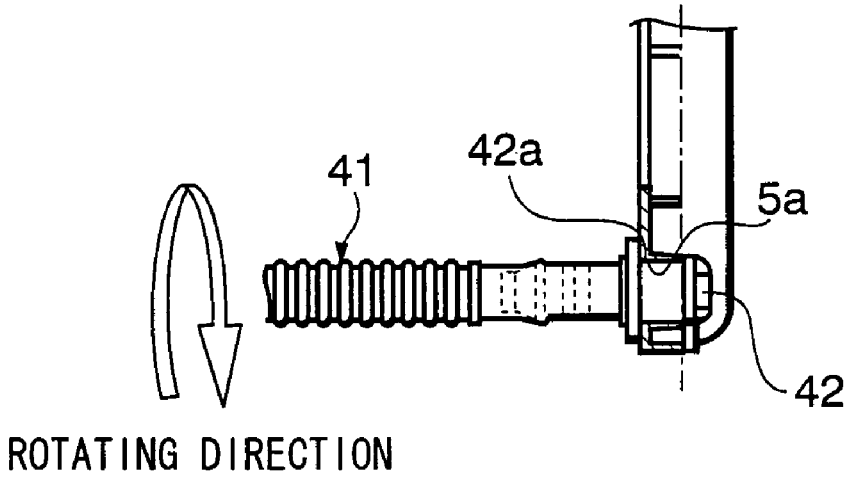
FIG. 4 is a diagram showing two examples of mounting structure of the fuel transfer tube to a fuel-flow gauge.
Figure 4:
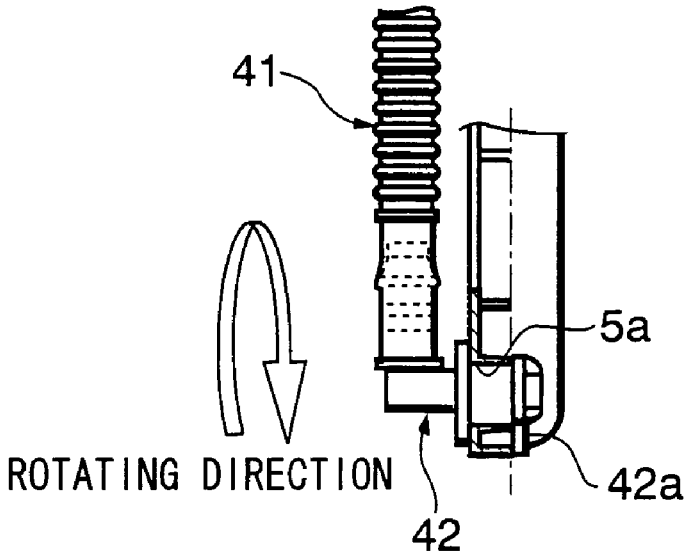

FIG. 4 shows embodiments of mounting structure of fuel inlet 4*a* of fuel transfer tube 4 to a lower wall of fuel-flow gauge 5. In the conventional technique, a fuel inlet of fuel transfer tube is press fitted into a mounting hole formed on a wall of fuel-flow gauge. However, in such a press fitting method, if there occurs a deviation in mounting direction, the excessive stress exerts on the fuel transfer tube or a connected part thereof. Since there is a restriction on the mounting direction, it is impossible to obtain the efficiency in mounting workability, maintenance performance and detachability.

Therefore, in the mounting structure shown in (A) of FIG. 4, a single-touch attachable connector member 42 is press fitted into an end portion on fuel inlet side of a body 41 of fuel transfer tube 4. In connector member 42, a claw 42*a* of ratchet structure in a spring mechanism, disposed on a tip portion of connector member 42 which is to be inserted into a mounting hole 5*a*, is retracted to the inner side to allow the tip portion to be inserted into mounting hole 5*a* when the tip portion is inserted into mounting hole 5*a*, and after completion of the insertion in which a flange 42*b* disposed rearward claw 42*a* comes in contact with a lower wall of fuel-flow gauge 5 to be locked, claw 42*a* projects so that connector member 42 is retained.

Further, by forming a diameter of the portion of connecting member 42, which is in engagement with mounting hole 5*a*, to be slightly smaller than that of mounting hole 5*a*, connecting member 42 can be axially rotated. Thus, it is possible to prevent the excessive stress from exerting on fuel transfer tube 4 and pump unit 2 being the connected part thereof, and fuel-flow gauge 5. As a result, since the restriction on the mounting direction is eliminated, the mounting workability, maintenance performance and detachability can be significantly improved.

The mounting structure shown in (B) of FIG. 4 shows fuel transfer tube 4 in which connector member 42 is bent into an L-shape. This mounting structure achieves an effect similar to that in the mounting structure in (A). Further, this mounting structure is advantageous in the case where the install space for fuel transfer tube 4 is narrow, such as, the case where fuel-flow gauge 5 is disposed closer to protruding portion 1*a* of saddle type fuel tank 1.

In the embodiments as shown in the above, the bellows portions and the straight portions are arranged alternately over the entire fuel transfer tube. However, in such a constitution where a portion on the auxiliary chamber side and a portion lying over the protruding portion (except for connector portion) are formed of a metal pipe, the bellows portions and the straight portions made of resin material may be arranged alternately on the main chamber side only.

The entire contents of Japanese Patent Application No. 2003-020213 filed Jan. 29, 2003, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed is:

1. A fuel supply system for an internal combustion engine, comprising:

a saddle type fuel tank provided with a main chamber and an auxiliary chamber on both sides of an upwardly protruding center portion of a bottom face thereof;

a fuel return pipe returning fuel from an engine body to said fuel tank;

a jet pump having a function for pumping the fuel to a main chamber side of said fuel tank by utilizing a negative pressure occurring due to a fuel ejection pressure from an outlet of said fuel return pipe; and a fuel transfer tube with one end portion connected to a fuel introduction port of said jet pump and the other end portion mounted to lie over said protruding portion, to face said auxiliary chamber, wherein at least a part of said fuel transfer tube is formed by arranging alternately a plurality of bellows portions each of which cross section is variable, and a plurality of straight portions each of which cross section is fixed, each of adjacent bellows portions having only one of the straight portions therebetween, and wherein a straight portion disposed downstream of one bellows portion has a length equal to or more than a length of the one bellows portion disposed upstream of the straight portion; and wherein said fuel transfer tube is configured to be formed by in bellows shape at a portion thereof, said fuel transfer tube being variable in accordance with the shape of the fuel tank.

2. A fuel supply system for an internal combustion engine according to claim 1, wherein said other end portion which faces said auxiliary chamber, of said fuel transfer tube is constituted by a connecter member which is inserted in a single-touch into a mounting hole formed on a mounting member for mounting said other end portion, to be retained.

3. A fuel supply system for an internal combustion engine according to claim 2, wherein said connector member is formed to be axially rotatable relative to said mounting hole.

4. A fuel supply system for an internal combustion engine according to claim 2, wherein said connector member is formed in an L-shape consisting of a mounting portion mounted to said mounting hole to extend axially and a bent portion bent at a right angle from said mounting portion.

5. A fuel supply system for an internal combustion engine according to claim 2, wherein the entirety of said fuel transfer tube is formed of resin material.

6. A fuel supply system for an internal combustion engine according to claim 1, wherein said fuel transfer tube is formed by arranging alternately the bellows portions and straight portions on a main chamber side only.

7. A fuel supply system for an internal combustion engine according to claim 6, wherein in said fuel transfer tube, a portion on the main chamber side is formed of resin material, and a portion of said fuel transfer tube on an auxiliary chamber side and a portion lying over said protruding portion are mainly formed of metal material.

8. A fuel supply system for an internal combustion engine according to claim 1, wherein said other end portion which faces said auxiliary chamber, of said fuel transfer tube is mounted to a fuel outlet of a fuel filter to introduce fuel via said fuel filter.

9. A fuel supply system for an internal combustion engine according to claim 1, wherein said jet pump together with a pump body discharging fuel to said engine is incorporated in a pump unit.

10. A fuel transfer tube connected to a fuel inlet of a fuel pump disposed in a fuel tank of an internal combustion engine, wherein said fuel transfer tube is formed by arranging alternately bellows portions each of which cross section is variable, and straight portions each of which cross section is fixed, each of adjacent bellows portions having only one of the straight portions therebetween, and wherein a straight portion disposed downstream of one bellows portion has a length equal to or more than a length of the one bellows portion disposed upstream of the straight portion;

wherein said fuel tank is a saddle type fuel tank provided with a main chamber and an auxiliary chamber on both sides of an upwardly protruding center portion of a bottom face thereof, and an end portion on a main chamber side is a jet pump having a function for pumping fuel by utilizing a negative pressure occurring due to a fuel ejection pressure from an outlet of a fuel return pipe; and wherein said fuel transfer tube is configured to be formed in bellows shape at a portion thereof, said fuel transfer tube being variable in accordance with the shape of the fuel tank.

11. A fuel transfer tube according to claim 10, wherein one end portion of said fuel transfer tube, being a fuel inlet on an opposite side of a fuel pump connection side, is constituted by a connecter member which is inserted in a single-touch into a mounting hole formed on a mounting member for mounting said one end portion, to be retained.

12. A fuel transfer tube according to claim 11, wherein said connector member is formed to be axially rotatable relative to said mounting hole.

13. A fuel transfer tube according to claim 11, wherein said connector member is formed in an L-shape consisting of a mounting portion mounted to said mounting hole to extend axially and a bent portion bent at a right angle from said mounting portion.

14. A fuel transfer tube according to claim 10, wherein the entirety of said fuel transfer tube is formed of resin material.

15. A fuel transfer tube according to claim 10, wherein the portion in which said bellows portions and said straight portions are arranged alternately is formed of resin material, and the remaining potion is mainly formed of metal material.

* * * * *